US006003194A

United States Patent [19]

Eckroth

[11] Patent Number: 6,003,194

[45] Date of Patent: Dec. 21, 1999

[54] HOSE CLEANING AND DRYING APPARATUS

[76] Inventor: Allan James Eckroth, 1505, 2nd Ave. N., Grand Forks, N. Dak. 58203

[21] Appl. No.: 08/943,990

[22] Filed: Oct. 3, 1997

[51] Int. Cl.[6] ..... A47L 5/38

[52] U.S. Cl. ..... 15/302; 15/306.1

[58] Field of Search ..... 15/302, 306.1; 134/199

[56] References Cited

U.S. PATENT DOCUMENTS

| | | | |
|---|---|---|---|
| 4,591,390 | 5/1986 | Scott et al. | 15/302 |
| 4,734,950 | 4/1988 | Schenke et al. | 15/88 |
| 5,056,185 | 10/1991 | Schotter | 15/302 |
| 5,077,861 | 1/1992 | Bokat | 15/256.5 |
| 5,566,415 | 10/1996 | Wallace | 15/88.1 |
| 5,634,236 | 6/1997 | Darsey | 15/302 |
| 5,783,044 | 7/1998 | Schneider et al. | 15/302 |

*Primary Examiner*—Terrence R. Till
*Assistant Examiner*—Theresa T. Snider
*Attorney, Agent, or Firm*—Curtis V. Harr

[57] ABSTRACT

A three chambered hose cleaning and drying head which attaches to the back of a cleaning vehicle. The cleaning head allows hoses to pass through each of the three respective chambers. As a hose passes through the first of these chambers it is sprayed with an encircling high pressure stream of the cleaning fluid which effectively removes all dirt and debris from its surface. This chamber subsequently vacuums away the dirt debris and much of the excess cleaning fluid. The other two chambers are vacuum chambers which remove the fluid from the hose and transfer it back to the cleaning system in order to dry the clean hose. This system can easily be used each time the hose is loaded on the truck or any time as desired. Therefore, the hose stays clean and dry regardless of the condition in which the cleaner is being used.

16 Claims, 4 Drawing Sheets

FIG 6
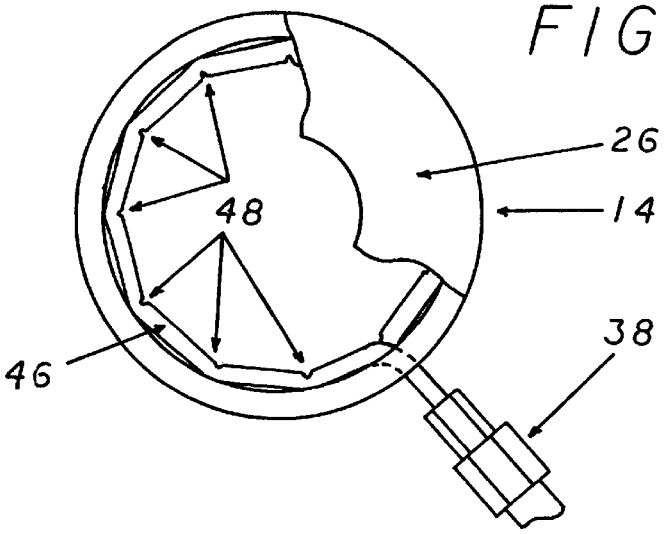
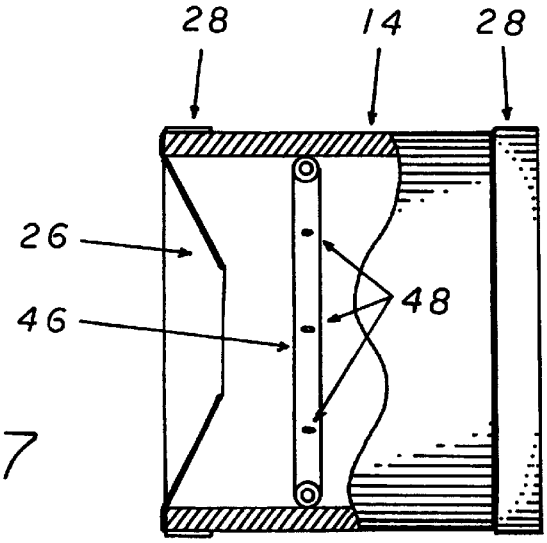
FIG 7
FIG 8
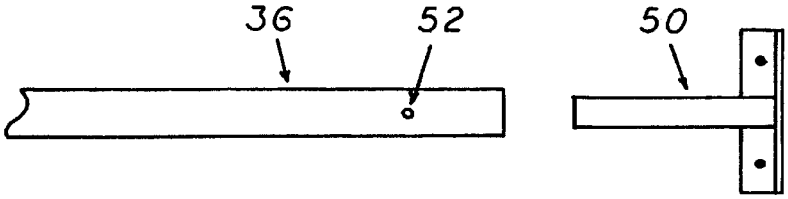

HOSE CLEANING AND DRYING APPARATUS

BACKGROUND OF THE INVENTION

The present invention relates generally to an apparatus for cleaning and drying hoses and more specifically to an apparatus for use on truck mounted carpet cleaners for cleaning and drying the hoses.

In the United States today, the majority of businesses, offices, homes and apartments employ carpeting as the main floor covering. Most business owners and homeowners have neither the time, nor the equipment to clean their carpets on their own, thus, commercial carpet cleaning businesses have been established to provide such a service. While some smaller carpets can be removed from the dwelling for the purpose of cleaning, many have been permanently installed, making removal for cleaning impossible. Thus, it is necessary for the cleaning equipment to be brought into the house.

The cleaning process is generally accomplished by use of a high power truck mounted carpet cleaning system. Typically, a van is used to house and transport the cleaning equipment. A long hose carrying cleaning solution and heated water under pressure runs from the vehicle to the area of the house which needs to be cleaned, allowing these solutions to be applied to the carpet. The dirty solution and water is then pulled out of the carpet and returned to a holding tank in the vehicle via a second vacuum hose.

While this system provides an effective, cost-efficient method of cleaning carpets, that cannot be removed from the dwelling, an inherent problem in this system is the fact that the hoses must travel from the vehicle outside the house to the area in the house where the carpet is located. The hoses must run along the ground inside and outside of the house and frequently become covered with dirt and other debris which is subsequently dragged into the area being cleaned, dirtying other carpets in the process. This process is amplified when the hoses become wet, making dirt cling more readily and occasionally covering the hose with mud.

From the above description it can be seen that it becomes important to provide an effective means for keeping the hoses on carpet cleaning systems clean and dry. Several hose or tube cleaning devices have been tried.

U.S. Pat. No. 5,077,861 (issued to Bokat) shows a tube-like apparatus encasing brushes through which a hose or cable is passed. Water is introduced such that it flows both in the same direction as the hose being pulled through the chamber (co-current flow) and in the opposite direction as the hose (countercurrent flow). In this manner, the water and brushes clean the hose, but this apparatus does not provide a method for drying the hose as it leaves the chamber. Additionally, while the water flows in two directions in order to clean the hoses, it is not pressurized and does not provide the maximum cleaning potential.

U.S. Pat. No. 5,566,415 (issued to Wallace) shows an apparatus through which cleaning hoses are passed as they are being wound onto a hose storage spool in the cleaning vehicle. Pressurized jets spray water onto the hoses, cleaning them, and waste water is drained into a waste pan and removed. However, this configuration, like the previously described patent, does not provide a method for drying the hoses completely, allowing for accumulation of dirt and mud on the hoses, especially if they are used again before they have a chance to dry.

U.S. Pat. No. 4,734,950 (issued to Schenke et al.) shows a cleaning apparatus employing an array of helically disposed brushes which clean the outer surfaces of hoses while cleaning solvent is circulated through the housing of the apparatus. A wiper ring, at the outlet of the housing through which the hoses pass, provides a means for removing moisture from the surface of the hose. While this apparatus provides a means for cleaning and drying hoses, it uses a cleaning solution rather than pressurized water, unnecessarily creating harmful fumes and environmentally unsafe waste. Additionally, the apparatus is large and bulky and does not lend itself to easy use in situations where portable cleaning equipment is used.

From the foregoing discussion, it can be seen that it would be highly desirable to provide an effective means for removing dirt and debris from carpet cleaning hoses especially the vacuum hose. Additionally, it would be highly desirable to provide a method for cleaning these hoses which also dries the hoses to prevent the clean hoses from attracting additional dirt and debris after the cleaning process. Further, it is desirable to provide a means which is portable and can be used in the cleaning vehicles which transport equipment to a variety of locations.

SUMMARY OF THE INVENTION

It is the objective of the present invention to provide a method of removing dirt and debris from the hoses used in commercial carpet cleaning.

It is an additional objective of the present invention to provide a method for cleaning these hoses which also dries the hoses to prevent the clean hoses from attracting additional dirt and debris during and after the cleaning process.

It is still a further objective of the present invention to provide such a cleaning and drying method which is portable and can be used in the cleaning vehicles typically used to transport cleaning equipment to a variety of locations.

These objectives are accomplished by use of a portable devise that can be easily attached and disengaged from the carpet cleaning equipment used today. The present invention comprises a three chambered cleaning head which attaches to the back of a cleaning vehicle. The cleaning head allows hoses to pass through each of the three respective chambers. As the hose passes through the first of these chambers it is sprayed with an encircling high pressure stream of the cleaning fluid, used in the carpet cleaning machine which effectively removes all dirt and debris from its surface. This chamber subsequently vacuums away the dirt debris and much of the excess cleaning fluid. The other two chambers are vacuum chambers which remove the fluid from the hose and transfer it back to the cleaning system in order to dry the clean hose. This system uses the existing vacuum hookup and solution system from the carpet cleaning equipment in the truck. Thus, installation of the system on an existing van is inexpensive and quick. This system can easily be used each time the hose is loaded on the truck, or any time as desired. Therefore, the hose stays clean and dry regardless of the conditions in which the cleaner is being used. The present invention is generally used for cleaning the larger ridged vacuum type hose, however, it should be readily apparent that different sizes of the present invention can be made to clean hoses of varying sizes. Specifically, if desired, a second smaller device could be utilized to clean the wash feed or solution carrying hose.

The above listed objectives of the present invention will become readily apparent upon further review of the following specifications and drawings. For a better understanding of the present invention, reference should be made to the drawings and the description in which there are illustrated and described preferred embodiments of the present invention.

DESCRIPTION OF THE DRAWINGS

FIG. 6 is a front elevation cut-away view of the washing chamber of the present invention showing the location and manner of construction of the washing component thereof.

FIG. 7 is a side elevation cut-away view of the washing chamber of the present invention, again showing the location and manner of construction of the washing component thereof.

FIG. 8 is a top elevation view of the cleaning head frame component of the present invention showing the manner in which it is capable of being separated to facilitate the easy removal of said invention from the vehicle.

DESCRIPTION OF THE PREFERRED EMBODIMENT

Figure 1:
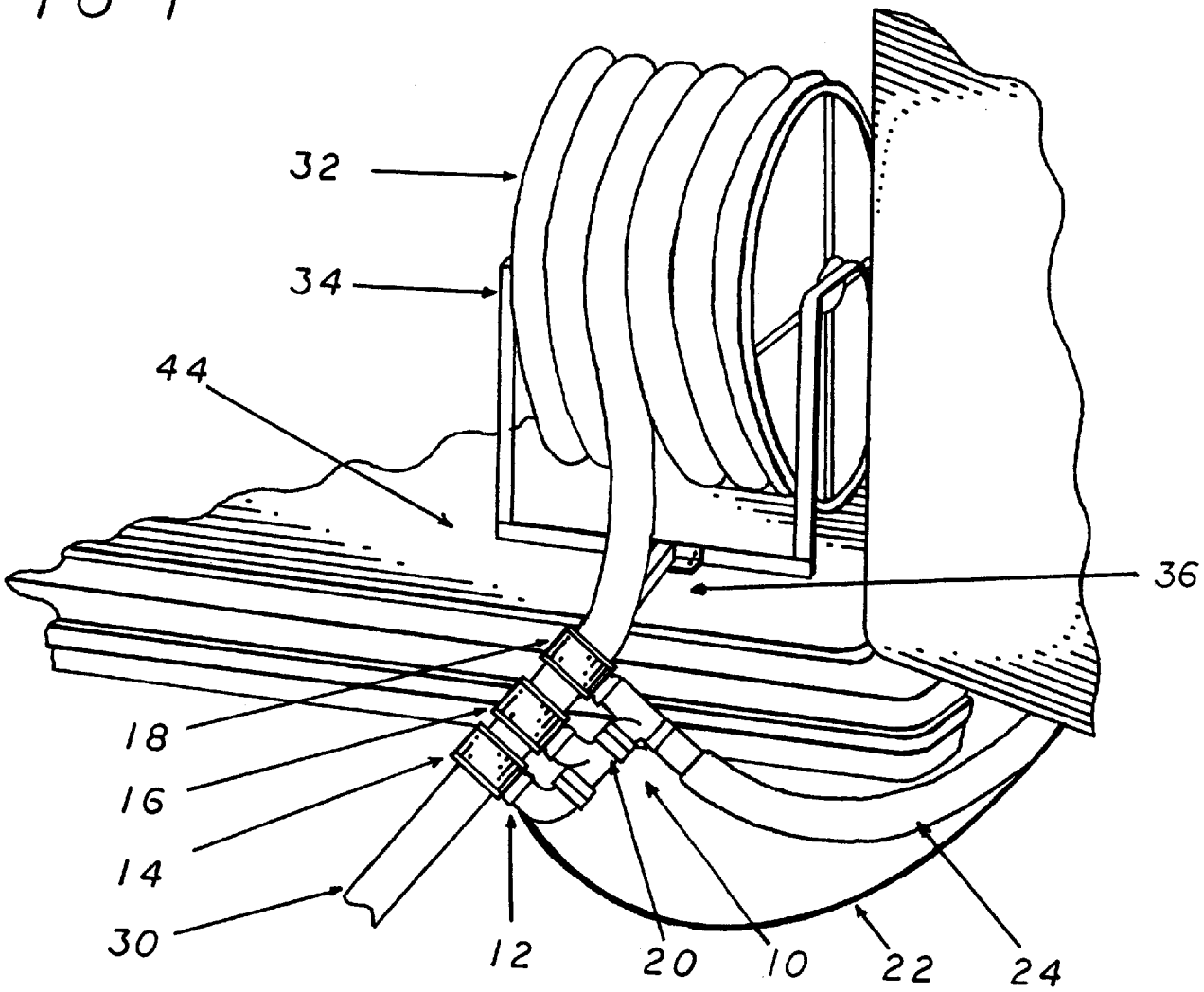
FIG. 1 is a perspective view of the Hose Cleaning and Drying Apparatus showing the orientation of the major components in relation to the rear of a vehicle typically used in the cleaning of carpets.
Figure 2:
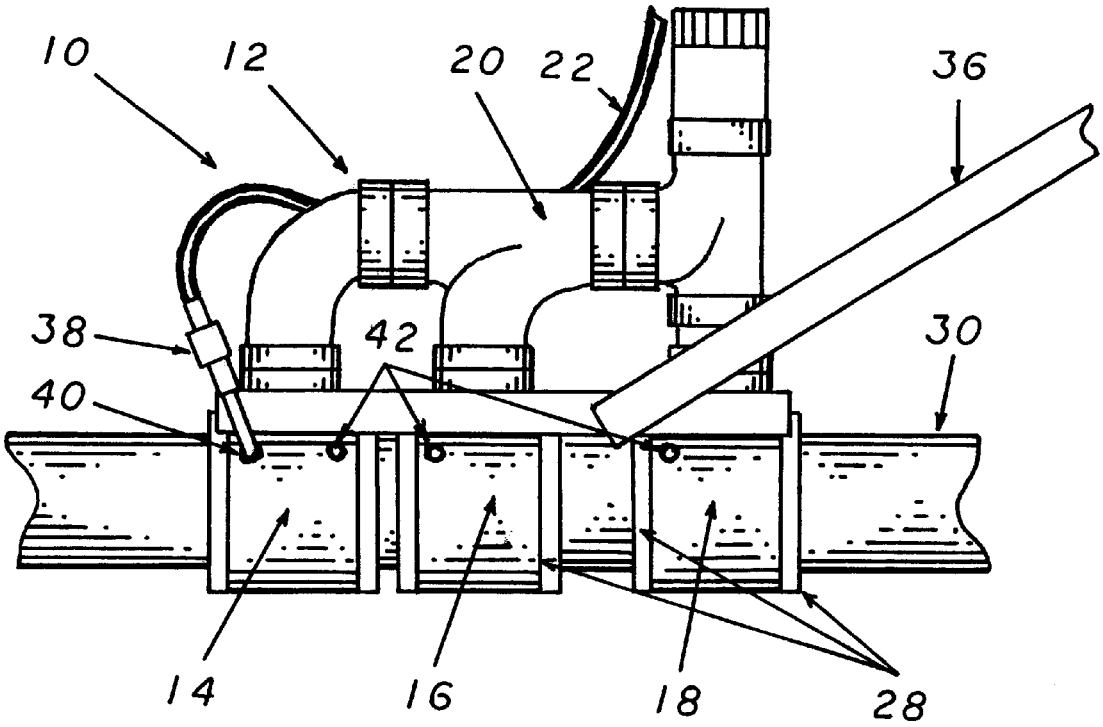
FIG. 2 is a side elevation view of the present invention showing its major components and the manner in which a vacuum hose engages the cleaning apparatus.
Figure 3:
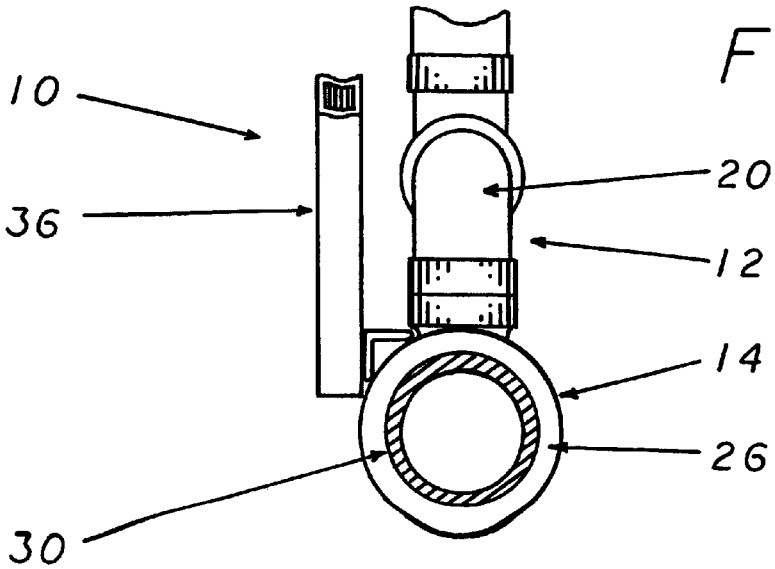
FIG. 3 is a front elevation view of the present invention showing the manner in which a typical vacuum hose fits within the seal of the cleaning chambers.
Figure 4:
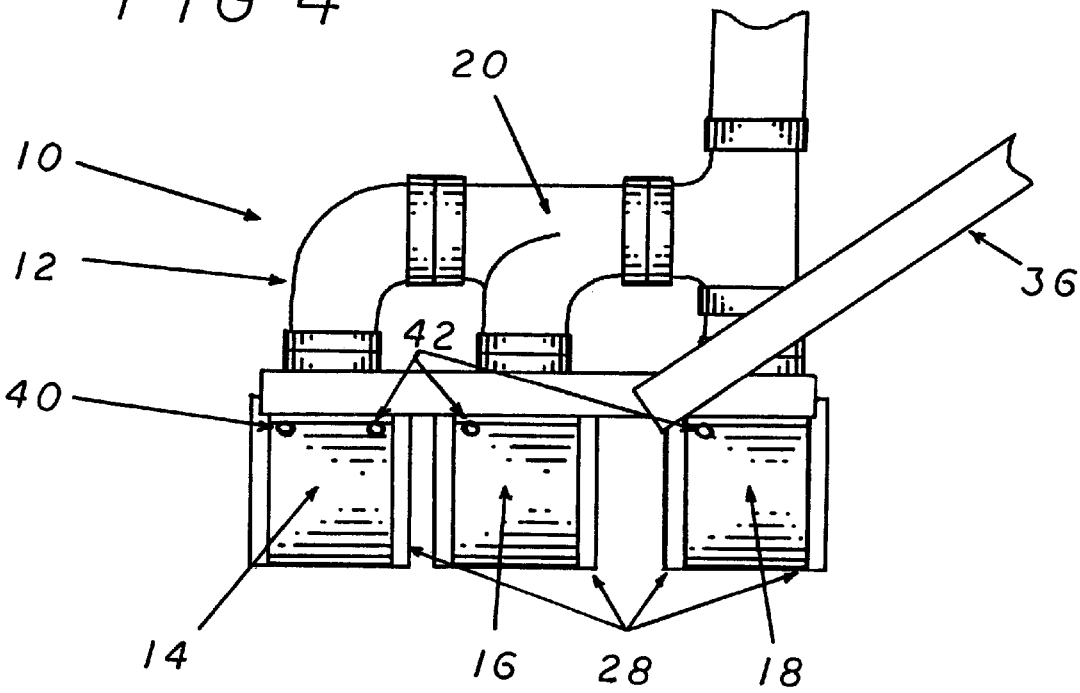
FIG. 4 is a side elevation view of the present invention showing the orientation of its major components.
Figure 5:
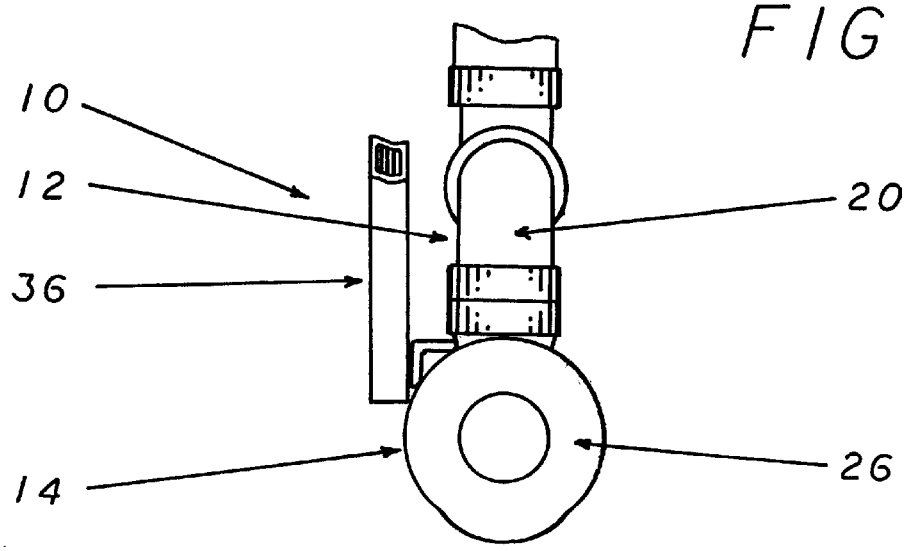
FIG. 5 is a front elevation view of the present invention showing the manner of construction of the hose seal located on the washing and drying chambers.

Referring now to the drawings, and more specifically to FIG. 1, the Hose Cleaning and Drying Apparatus 10 attaches to the back of a cleaning vehicle 44 by means of the cleaning head frame 36 which is, in turn, attached at its most rearward end to the base of the vacuum hose reel frame 34. The vacuum hose reel frame 34, which is secured to the rear of the cleaning vehicle 44, supports the vacuum hose reel 32 upon which the vacuum hose 30 is stored when not in use.

As the vacuum hose 30 is fed onto the vacuum hose reel 32, from a work site, it passes first through the cleaning chamber 14, then the primary drying chamber 16, and finally the secondary drying chamber 18. These chambers are attached to the collection manifold 20 of the cleaning head 12. The cleaning chamber 14 is supplied with cleaning fluid by the cleaning solution feed hose 22 and attached to the other end of the collection manifold 20 is the vacuum supply hose 24 which supplies the necessary vacuum pressure to remove the used cleaning fluid from the cleaning chamber 14 and drying chambers, 16 and 18. The vacuum supply hose 24 and the cleaning solution feed hose 22 are connected to the cleaning device employed in the carpet cleaning operation.

FIGS. 2, 3, 4, and 5, show the manner of construction of the cleaning head 12 component of the present invention. The cleaning head 12 is made up of three cylindrical cleaning chambers, the wash chamber 14, the primary drying chamber 16, and the secondary drying chamber 18. Each of these chambers has on either end a circular hose seal 26 through which the vacuum hose 30 passes and seals the inside of the chamber while the vacuum hose 30 is engaged. The hose seals are typically formed from a piece of flexible material, such as rubber, which will form a seal about the hose being cleaned and aid in wiping the hose as it is pulled through the Hose Cleaning and Drying Apparatus 10. The hose seals 26 are held in place by the use of the seal clamps 28 which extend around the outside circumference of the chambers 14, 16, and 18 at both ends.

The wash chamber 14 is supplied with the high pressure and temperature cleaning solution through the cleaning solution feed hose 22 which is connected to the cleaning head 12 at the hose coupler 38, which is mounted in the washer attachment hole 40 located on its outer surface. The cleaning solution feed hose 22 is fed solution by the carpet cleaning machine mounted in the cleaning vehicle 44. This solution would typically be the standard mix used in the cleaning of carpets, but may be mixed as desired including the use of pure water. A vacuum is supplied to each chamber from the vacuum supply hose 24 through the collection manifold 20. Also, each of these chambers has on its outer surface a chamber vent hole 42 which allows a small amount of air into the chambers to facilitate the movement of air into the collection manifold 20.

Thus, as the vacuum hose 30 passes through the wash chamber 14 it is sprayed with a high pressure fluid which removes the dirt and debris from its surface. As the wash chamber is supplied with vacuum pressure, most of the used fluid is removed from the vacuum hose 30 at this point. After leaving the cleaning chamber 14, the vacuum hose 30 then enters the primary drying chamber 16 which removes more of the fluid in the manner described above. Finally, after leaving the primary drying chamber 16, the vacuum hose 30 enters the secondary drying chamber 18 where any remaining fluid is removed and transferred to the vacuum supply hose 24 through the collection manifold 20. It has been found that the use of three chambers appears to be optimal, however, it should be stated that the invention will work with two chambers should a hose that is less dry be desired.

FIGS. 6 and 7 detail the manner of construction of the present invention's vacuum hose 30 spraying apparatus. The injection ring 46 extends from the hose coupler 38 and passes through the outer wall of the wash chamber 14 and encircles the interior of said chamber. The injection ring is typically formed from a piece of copper tubing or other suitable material. The injection ring 46 has evenly spaced, and inwardly facing, injection holes 48 through which the cleaning fluid is forced into the interior of the cleaning chamber 14. In this manner the vacuum hose 30 is completely enveloped with a plurality of high pressure cleaning streams which completely removes all foreign matter therefrom. Other embodiments of the ring may be a series of nozzles connected with a portion of line, thus, other variations are possible.

FIG. 8 depicts the manner in which the cleaning head frame 36 is constructed. The cleaning head frame 36 is attached at its most rearward end to the cleaning head 12 and extends forward from there. At its most forward end, the cleaning head frame 36 forms a square hollow tube which slides over the cleaning head frame mount 50 which is, in turn, attached to the vacuum hose reel frame 34. The cleaning head frame 36 is then held in place on the cleaning head frame mount by the use of the set screw 52 or pin (not pictured), which passes through the cleaning head frame 36 and engages the surface of the cleaning head frame mount 50. The pin mount (not pictured), would pass through the cleaning head frame mount 50 and could be secured with a clip or other means. This method of construction facilitates the quick and easy removal of the present invention from the cleaning vehicle 44 when the system is not in use.

Although the present invention has been described in considerable detail with reference to certain preferred versions thereof, other versions are possible. Therefore, the spirit and scope of the appended claims should not be limited to the description of the preferred versions contained herein.

What is claimed:

1. A hose cleaning and drying apparatus to be connected to a first outlet for the output of cleaning solution and a second outlet for a vacuum source to return of said cleaning solution, a plurality of hoses to connect said first and second outlets to said hose cleaning and drying apparatus said apparatus comprising:

a manifold section for connection to said second outlet;

a washing chamber for connection to said first outlet said washing chamber further being connected to said manifold, said washing chamber defining a first opening for receiving a hose to be cleaned and a second opening for the exit of said hose;

a means for spraying said hose with cleaning solution as it passes through said washing chamber;

a drying chamber connected to said manifold said drying chamber being distinct from said washing chamber and defining a first opening for receiving said hose to be dried and a second opening for the exit of said hose; and a means for drying said hose as it passes through said drying chamber.

2. A hose cleaning and drying apparatus as in claim 1 wherein said means for spraying is a length of tubing connected to said first outlet for the output of cleaning solution, said length of tubing forms a ring inside of said first washing chamber so as to encircle said hose as it passes through said washing chamber, said length of tubing has a plurality of injection holes so as to spray said cleaning solution about said hose to remove debris from said hose.

3. A hose cleaning and drying apparatus as in claim 2 wherein said means for drying comprises;

a connection on said manifold section to said second outlet; and a chamber vent on said drying chamber which draws air into said drying chamber creating a flow of air that vacuums the hose in said drying chamber returning any liquids and debris through said manifold to said second outlet.

4. A hose cleaning and drying apparatus as in claim 3 wherein said washing chamber further comprises a chamber vent which draws air into said washing chamber creating a flow of air that vacuums the hose in said washing chamber returning liquids and debris through said manifold to said second outlet.

5. A hose cleaning and drying apparatus as in claim 4 further comprising a second drying chamber connected to said manifold section having a first opening for receiving said hose to be dried and a second opening for the exit of said hose.

6. A hose cleaning and drying apparatus as in claim 5 further comprising a circular rubber seal encircling said first and second openings of said chambers.

7. A hose cleaning and drying apparatus for use on a vehicle having a professional type vehicle mounted carpet cleaning system with a first outlet for the output of cleaning solution and a second outlet for a vacuum return of said solution, a plurality of hoses to connect said first and second outlets with the carpet to be cleaned, said hose cleaning and drying apparatus comprising:

a manifold section for connection to said second outlet;

a washing chamber connected to said manifold said washing chamber defining a a first opening for receiving a hose to be cleaned and a second opening for the exit of said hose;

a means of spraying said hose with cleaning solution as it passes through said washing chamber;

a drying chamber connected to said manifold said drying chamber being distinct from said washing chamber and defining a first opening for receiving said hose to be dried and a second opening for the exit of said hose;

a means for drying said hose as it passes through said drying chamber; and a means for flexibly sealing said first and second openings on said chambers to said hose as said hose passes through said chambers.

8. A hose cleaning and drying apparatus as in claim 7 wherein said means for spraying is a length of tubing connected to said first outlet for the output of cleaning solution, said tubing is formed into a ring inside of said first washing chamber so as to encircle said hose as it passes through said chamber, said tubing is further provided with a plurality of injection holes so as to spray said cleaning solution about said hose to remove debris from said hose.

9. A hose cleaning and drying apparatus as in claim 8 wherein said means for drying comprises;

a connection on said manifold section to said second outlet; and a chamber vent on said drying chamber which draws air into said drying chamber creating a flow of air that vacuums the hose in said drying chamber returning any liquids and debris through said manifold to said second outlet.

10. A hose cleaning and drying apparatus as in claim 9 wherein said washing chamber further comprises a chamber vent which draws air into said washing chamber creating a flow of air that vacuums the hose in said washing chamber returning liquids and debris through said manifold to said second outlet.

11. A hose cleaning and drying apparatus as in claim 10 further comprising a second drying chamber connected to said manifold section having a first opening for receiving said hose to be dried and a second opening for the exit of said hose.

12. A hose cleaning and drying apparatus as in claim 11 wherein said means for flexibly sealing on said first and second openings of said chambers is a circular rubber seal having a circular opening for the passage of said hose.

13. A hose cleaning and drying apparatus for use with a professional type carpet cleaning system with a first outlet for the output of cleaning solution and a second outlet for a vacuum return of said solution, a plurality of hoses to connect said first and second outlets with the carpet to be cleaned, said hose cleaning and drying apparatus comprising:

a manifold section for connection to said second outlet;

a washing chamber connected to said manifold said washing chamber defining a first opening for receiving a hose to be cleaned and a second opening for the exit of said hose;

a length of tubing connected to said first outlet for the output of cleaning solution, said length of tubing forms a ring inside of said first washing chamber so as to encircle said hose as it passes through said chamber, said length of tubing has a plurality of injection holes so as to spray said cleaning solution about said hose to remove debris from said hose;

a first drying chamber connected to said manifold said first drying chamber defining a first opening for receiving said hose to be dried and a second opening for the exit of said hose;

a second drying chamber connected to said said manifold said second drying chamber defining a first opening for receiving said hose to be dried and a second opening for the exit of said hose;

a means for drying said hose as it passes through said drying chambers; and a means for flexibly sealing said first and second openings on said chambers to said hose as said hose passes through said chambers.

14. A hose cleaning and drying apparatus as in claim 13 wherein said means for drying comprises;

a connection on said manifold section to said second outlet; and a chamber vent on said drying chamber which draws air into said first and second drying chamber creating a flow of air that vacuums the hose in said drying chambers returning any liquids and debris through said manifold to said second outlet.

15. A hose cleaning and drying apparatus as in claim 14 wherein said washing chamber further comprises a chamber vent which draws air into said washing chamber creating a flow of air that vacuums the hose in said washing chamber returning liquids and debris through said manifold to said second outlet.

16. A hose cleaning and drying apparatus as in claim 15 wherein said means for flexibly sealing on said first and second openings of said chambers is a circular rubber seal having a circular opening for the passage of said hose.

* * * * *